US012392262B2

(12) United States Patent
Nogami et al.

(10) Patent No.: US 12,392,262 B2
(45) Date of Patent: Aug. 19, 2025

(54) COMPRESSOR TRAIN FOR CHEMICAL PLANT

(71) Applicant: MITSUBISHI HEAVY INDUSTRIES COMPRESSOR CORPORATION, Hiroshima (JP)

(72) Inventors: Tomoaki Nogami, Hiroshima (JP); Dinesh Bhakar, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 0 days.

(21) Appl. No.: 18/920,128

(22) Filed: Oct. 18, 2024

(65) Prior Publication Data

US 2025/0137390 A1 May 1, 2025

(30) Foreign Application Priority Data

Oct. 31, 2023 (JP) ..... 2023-186483

(51) Int. Cl.
*F01K 7/22* (2006.01)
*F01K 7/16* (2006.01)

(52) U.S. Cl.
CPC ..... *F01K 7/22* (2013.01); *F01K 7/165* (2013.01)

(58) Field of Classification Search
CPC ..... F01K 7/22; F01K 7/165
See application file for complete search history.

(56) References Cited

U.S. PATENT DOCUMENTS 4,301,404 A * 11/1981 Ley ..... G01R 23/16 702/77
5,634,340 A * 6/1997 Grennan ..... F02C 6/16 60/648
2006/0228284 A1* 10/2006 Schmidt ..... C10K 1/005 423/352
2014/0283518 A1* 9/2014 Majumdar ..... F01K 7/16 60/670
2018/0171818 A1* 6/2018 Nimchan ..... F16K 31/1221
2022/0186630 A1* 6/2022 Nishiyama ..... F16K 1/44
2023/0272722 A1* 8/2023 Katayama ..... F01D 17/18 415/151
2024/0296966 A1* 9/2024 Lang ..... G21D 3/001

FOREIGN PATENT DOCUMENTS

JP 1-182501 * 7/1989
JP 2000-154020 A 6/2000

* cited by examiner

*Primary Examiner* — Hoang M Nguyen
(74) *Attorney, Agent, or Firm* — Osha Bergman Watanabe & Burton LLP

(57) ABSTRACT

A compressor train for a chemical plant includes a compression unit configured to compress a process gas of the chemical plant by being driven, a motor configured to drive the compression unit, a steam turbine rotated by steam generated in association with treatment of the process gas of the chemical plant and configured to assist in rotation of the motor, a steam introduction line through which the steam flows toward the steam turbine, and a main trip and throttle valve disposed on the steam introduction line and configured to regulate a flow rate of the steam to the steam turbine.

4 Claims, 3 Drawing Sheets

COMPRESSOR TRAIN FOR CHEMICAL PLANT

BACKGROUND OF THE INVENTION

Field of the Invention

The present disclosure relates to a compressor train for a chemical plant.

Priority is claimed on Japanese Patent Application No. 2023-186483, filed on Oct. 31, 2023, the content of which is incorporated herein by reference.

Description of Related Art

For example, Patent Document 1 discloses a compressor system for producing ammonia used in an ammonia plant as a chemical plant for generating ammonia. The compressor system for producing ammonia includes a compressor on a low pressure side and a compressor on a high pressure side (hereinafter, referred to as a compression unit), and a driving machine (steam turbine) that drives the compression unit.

It is common to use the power of a steam turbine (driving machine) to drive the compression unit. In addition, a configuration in which an electric motor (motor) is used in combination is also proposed in order to supplement the power of the driving machine.

PRIOR ART DOCUMENTS

Patent Document

[Patent Document 1] Japanese Unexamined Patent Application, First Publication No. 2000-154020

SUMMARY OF THE INVENTION

Problems to be Solved by the Invention

However, in addition to the above-described configuration, it is also considered a configuration in which the compression unit is mainly driven by the electric motor, and the power of the electric motor is assisted by the steam turbine. In that case, precise control such as steam flow rate is no longer required for the steam turbine. Therefore, there is a problem that the configuration of the steam turbine in the plant in the related art is over-specified, which leads to an increase in operating costs and maintenance costs.

An object of the present disclosure is to provide a compressor train for a chemical plant with a simpler configuration.

Means for Solving the Problems

A compressor train for a chemical plant according to the present disclosure includes a compression unit configured to compress a process gas of the chemical plant by being driven, a motor configured to drive the compression unit, a steam turbine rotated by steam generated in association with treatment of the process gas of the chemical plant and configured to assist in rotation of the motor, a connection line through which the steam flows, and a main trip and throttle valve disposed on the connection line and configured to block or cause the steam to flow into the steam turbine.

Effects of the Invention

According to the present disclosure, it is possible to provide a compressor train for a chemical plant with a simpler configuration.

DETAILED DESCRIPTION OF THE INVENTION

Hereinafter, a compressor train for a chemical plant according to the embodiment of the present disclosure will be described with reference to the accompanying drawings.

(Compressor Train for Chemical Plant)

The compressor train for a chemical plant compresses the process gas generated in the chemical plant and supplies the compressed process gas to a reactor disposed in the chemical plant.

In a case where the chemical plant is an ammonia plant, the reactor may be exemplified by an ammonia converter that generates ammonia by a chemical reaction under high temperature and high pressure, and the process gas may be exemplified by a gas containing hydrogen as a main component. The chemical plant in the present embodiment is an ammonia plant that produces ammonia.

Figure 1:
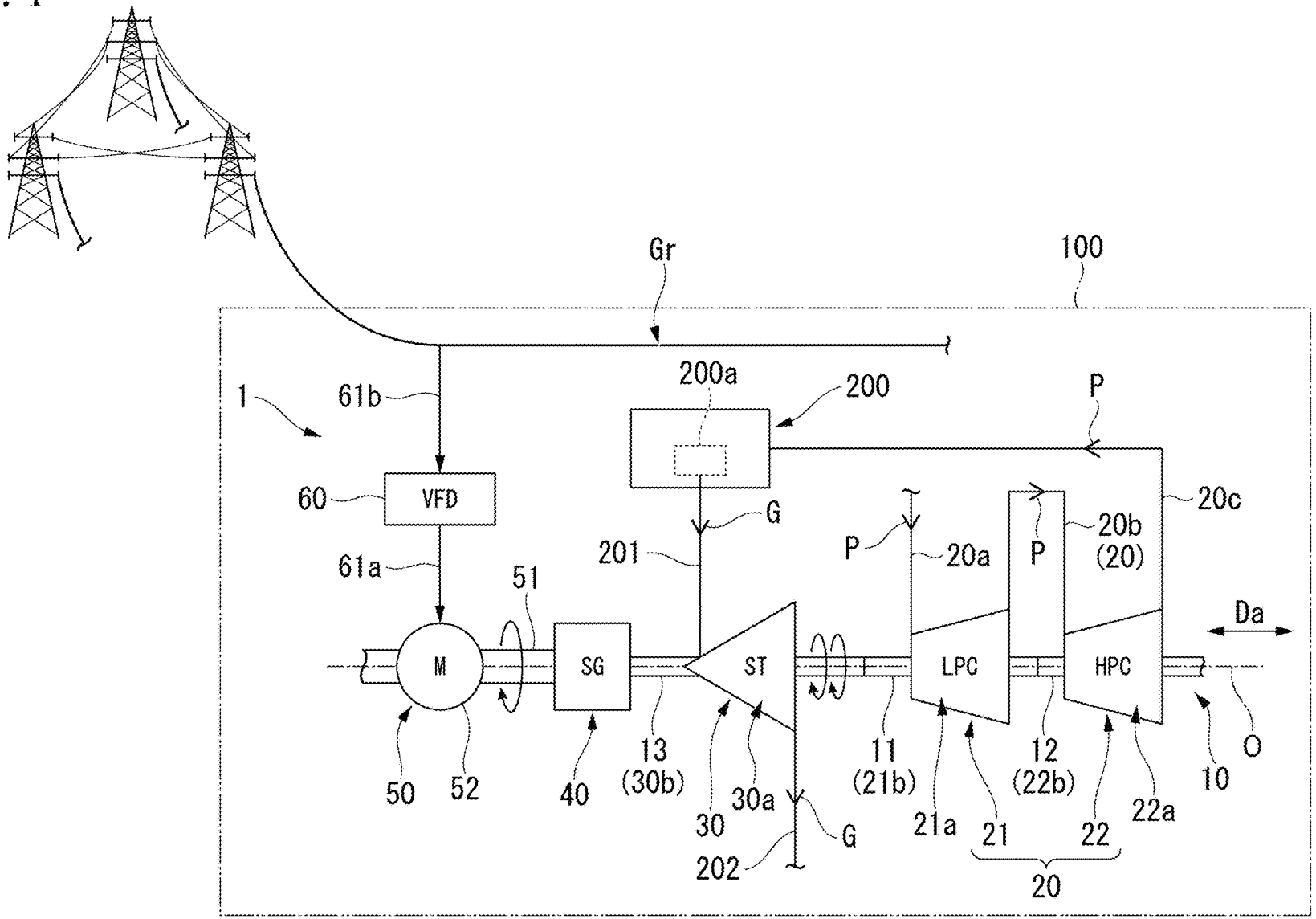
FIG. 1 is a schematic view showing a configuration of a compressor train for a chemical plant according to an embodiment of the present disclosure.

As shown in FIG. 1, an ammonia plant 100 is provided with a compressor train 1 for a chemical plant, an ammonia converter 200, a gas introduction line 20*a*, a gas exhaust line 20*c*, a first power purchase cable 61*a*, and a second power purchase cable 61*b*.

The compressor train 1 for a chemical plant is provided with a compression unit 20, a steam turbine 30, a speed increasing gear 40, a motor 50, a frequency conversion unit 60, a condenser 90, a condensate pump 95, a grand condenser 110, a vacuum pump 120, a vapor fan 125, a drain separator 130, a steam introduction line 201, a steam exhaust line 202, a connection line 160, a drainage line 170, a circulation line 180, a condensate recovery line 190, a first suction line 210, a second suction line 220, a leak steam line 230, a governing valve 240, a dump valve 250, a first opening and closing valve 260, a second opening and closing valve 270, and a main trip and throttle valve 280.

(Compression Unit)

The compression unit 20 compresses the process gas P supplied from the outside used in the ammonia plant 100 and supplies the compressed process gas P to the ammonia converter 200.

The compression unit 20 includes a low pressure stage compressor 21 (low pressure compressor: LPC), a high pressure stage compressor 22 (high pressure compressor: HPC), and an intermediate line 20*b*.

The low pressure stage compressor 21 is a rotary machine that increases the process gas P supplied from the outside to a predetermined first pressure value. The low pressure stage compressor 21 includes a first casing 21*a* and a first rotor 21*b*.

The first casing 21*a* is a member constituting an outer shell of the low pressure stage compressor 21. The first casing 21*a* is supported by a compressor support portion (not shown) fixed to the ground, a frame, or the like, and causes the process gas P to flow inside.

The first casing 21*a* has a casing main body (not shown), an inlet port (not shown) for inhaling the process gas P, which is formed in the casing main body, and a discharge port (not shown) for discharging the process gas P, which is formed in the casing main body.

The first rotor 21*b* includes a first rotation shaft 11, and a plurality of stages of impellers (not shown) that are fixed to the first rotation shaft 11 and form a flow path for compressing the process gas P together with an inner surface of the casing main body of the first casing 21*a*.

The first rotation shaft 11 is a driving shaft that forms a columnar shape extending in the axial direction Da (left-right direction in FIG. 1) and is rotatable about the axis O extending in the horizontal direction. Hereinafter, a direction where the axis O extends is referred to as an "axial direction Da". The first rotation shaft 11 is made of a metal or the like. The casing main body of the first casing 21*a* is fixed to the first rotation shaft 11 in a non-rotatable manner, for example, via a bearing device, a sealing device, or the like.

The impeller is accommodated in the casing main body of the first casing 21*a*. The impellers are arranged on the first rotation shaft 11 to be aligned in the axial direction Da and rotate about the axis O integrally with the first rotation shaft 11.

A flow of the process gas P introduced into the low pressure stage compressor 21 will be described below. The gas introduction line 20*a*, which is a pipe for introducing the process gas P before compression, is connected to an inlet port of the first casing 21*a* in the low pressure stage compressor, and the process gas P is introduced from a process gas treatment device (not shown) outside the compression unit 20 in the ammonia plant 100 through the gas introduction line 20*a*.

The process gas P introduced into the inside of the first casing 21*a* via the inlet port is sequentially compressed by the impeller of the first rotor 21*b* that rotates at a high speed inside the first casing 21*a*. The process gas P compressed to a first pressure value by the impeller of the last stage is discharged to the outside of the low pressure stage compressor 21 via the discharge port of the first casing 21*a*.

The high pressure stage compressor 22 is a rotary machine that increases the pressure of the process gas P compressed by the low pressure stage compressor 21 to a second pressure value higher than the first pressure value. The high pressure stage compressor 22 and the low pressure stage compressor 21 are connected to each other by an intermediate line 20*b* which is a pipe for causing the process gas P to flow.

That is, the process gas P compressed by the low pressure stage compressor 21 is introduced into the high pressure stage compressor 22 via the intermediate line 20*b*. For example, the second pressure value in the present embodiment is a pressure (atmospheric pressure) required for the chemical reaction in the ammonia converter 200.

The high pressure stage compressor 22 is disposed on one side (right side in FIG. 1) in the axial direction Da than the low pressure stage compressor 21. The high pressure stage compressor 22 includes a second casing 22*a* and a second rotor 22*b*.

The second casing 22*a* is a member constituting an outer shell of the high pressure stage compressor 22. The second casing 22*a* is supported by a compressor support portion (not shown) fixed to the ground, a frame, or the like, and causes the process gas P to flow inside.

The second casing 22*a* has a casing main body (not shown), an inlet port (not shown) for inhaling the process gas P, which is formed in the casing main body, and a discharge port (not shown) for discharging the process gas P, which is formed in the casing main body.

The second rotor 22*b* includes a second rotation shaft 12, and a plurality of stages of impellers (not shown) that are fixed to the second rotation shaft 12 and form a flow path for compressing the process gas P together with an inner surface of the casing main body of the second casing 22*a*.

The second rotation shaft 12 is a driving shaft that forms a columnar shape extending in the axial direction Da and is rotatable about the axis O. The second rotation shaft 12 is made of a metal or the like. The casing main body of the second casing 22*a* is fixed to the second rotation shaft 12 in a non-rotatable manner, for example, via a bearing device, a sealing device, or the like.

The impeller is accommodated in the casing main body of the second casing 22*a*. The impellers are arranged on the second rotation shaft 12 to be aligned in the axial direction Da and rotate about the axis O integrally with the second rotation shaft 12.

Here, an end portion of the first rotor 21*b* of the low pressure stage compressor 21 on one side in the axial direction Da of the first rotation shaft 11 and an end portion of the second rotor 22*b* of the high pressure stage compressor 22 on the other side in the axial direction Da the second rotation shaft 12 are integrally connected to each other. Specifically, the first rotation shaft 11 and the second rotation shaft 12 are elastically connected to each other by a coupling or the like (not shown) having flexibility.

The first rotation shaft 11 and the second rotation shaft 12 are connected to each other such that the centers of both are aligned. That is, the center line of the first rotation shaft 11 and the center line of the second rotation shaft 12 are on the same straight line. That is, the first rotation shaft 11 and the second rotation shaft 12 share the axis O as the center line.

The two-stage compressor mechanism (multi-stage compressor) includes the low pressure stage compressor 21 and the high pressure stage compressor 22.

A flow of the process gas P introduced into the high pressure stage compressor 22 will be described below. The process gas P introduced into the inside of the second casing 22*a* via the inlet port of the second casing 22*a* is compressed by the second rotor 22*b* that rotates at a high speed inside the second casing 22*a*.

The process gas P compressed to the second pressure value by the impeller of the last stage is discharged to the outside of the high pressure stage compressor 22 via the discharge port of the second casing 22*a*. The gas exhaust line 20*c*, which is a pipe for discharging the process gas P after compression, is connected to the discharge port, and the process gas P is supplied to the ammonia converter 200 outside the compression unit 20 via the gas exhaust line 20*c*.

The process gas P (H2) introduced into the ammonia converter 200 through the compression unit 20 is used for a chemical reaction with nitrogen (N2) in the ammonia converter 200 in the presence of a catalyst. In this chemical reaction, ammonia (NH3) is generated in the ammonia converter 200.

The ammonia converter 200 is provided with a boiler 200*a* as a heat exchanger that generates steam G by using heat generated in the chemical reaction. The steam G generated in the boiler 200*a* of the ammonia converter 200 is introduced into the steam turbine 30 as an operating fluid of the steam turbine 30.

(Motor)

The motor (M) 50 is a rotary machine as an electric motor that drives the compression unit 20. The motor 50 is applied with a voltage from the outside and is rotated at a rotation speed based on the magnitude of the applied voltage. The motor 50 includes an output shaft 51 and a motor main body 52.

The output shaft 51 is a columnar member (motor shaft) made of metal or the like, which extends in the axial direction Da and is rotatable about the axis O. An end portion of the output shaft 51 on one side in the axial direction Da is connected to the speed increasing gear 40. Specifically, the end portion of the output shaft 51 on one side in the axial direction Da is fixed to a pinion gear of a gear coupling of the speed increasing gear 40.

Here, the output shaft 51 and the rotation shaft 10 are spaced apart from each other in the horizontal direction, and the center line of the rotation shaft 10 and the center line of the output shaft 51 are on the same straight line. That is, the output shaft 51 and the rotation shaft 10 share the axis O as the center line.

The motor main body 52 has, for example, a motor stator (not shown) as a stator and a motor rotor (not shown) as a rotor and integrally fixed to the output shaft 51.

The motor stator is electrically connected to a device outside the motor 50. When a current flows through the coil included in the motor stator, an electromagnetic force for rotating the motor rotor in a circumferential direction of the output shaft 51 with the axis O as a reference (center) is generated.

Therefore, when the power is input from the outside to the motor stator of the motor main body 52, the output shaft 51 is rotated. When the output shaft 51 is rotated, the speed increasing gear 40 that connects the output shaft 51 and the turbine rotation shaft 13 increases the rotation speed of the turbine rotation shaft 13 to a speed higher than the rotation speed of the motor 50.

(Speed Increasing Gear)

The speed increasing gear 40 (step-up gear: SG) is a gear device (gear box) that connects the rotation shaft 10 and the motor 50 to each other and can increase the rotation speed of the rotation shaft 10 to a speed higher than the rotation speed of the motor 50.

That is, the speed increasing gear 40 is interposed between the compression unit 20 and the motor 50 and can increase the rotation speed of the first rotation shaft 11 and the second rotation shaft 12 in the compression unit 20 and the rotation speed of the turbine rotation shaft 13 of the steam turbine 30 to a speed higher than the rotation speed of the motor 50.

The speed increasing gear 40 in the present embodiment has, for example, a gear coupling, which is a type of flexible shaft coupling, including a plurality of pinion gears arranged in the axial direction Da.

The pinion gear of the gear coupling is fixed such that an end portion of the rotation shaft 13 on the other side in the axial direction Da of the rotation shaft 10 and a part of the motor 50 are covered from the outside. The speed increasing gear 40 connects the rotation shaft 10 and the motor 50 at a predetermined gear ratio.

(Steam Turbine)

The steam turbine (ST) 30 is a rotary machine that assists in driving the compression unit 20 by using the steam G generated in association with the treatment of the process gas P of the ammonia plant 100. The steam G generated in the boiler 200*a* of the ammonia converter 200 is introduced into the steam turbine 30 in the present embodiment via the steam introduction line 201.

Figure 2:
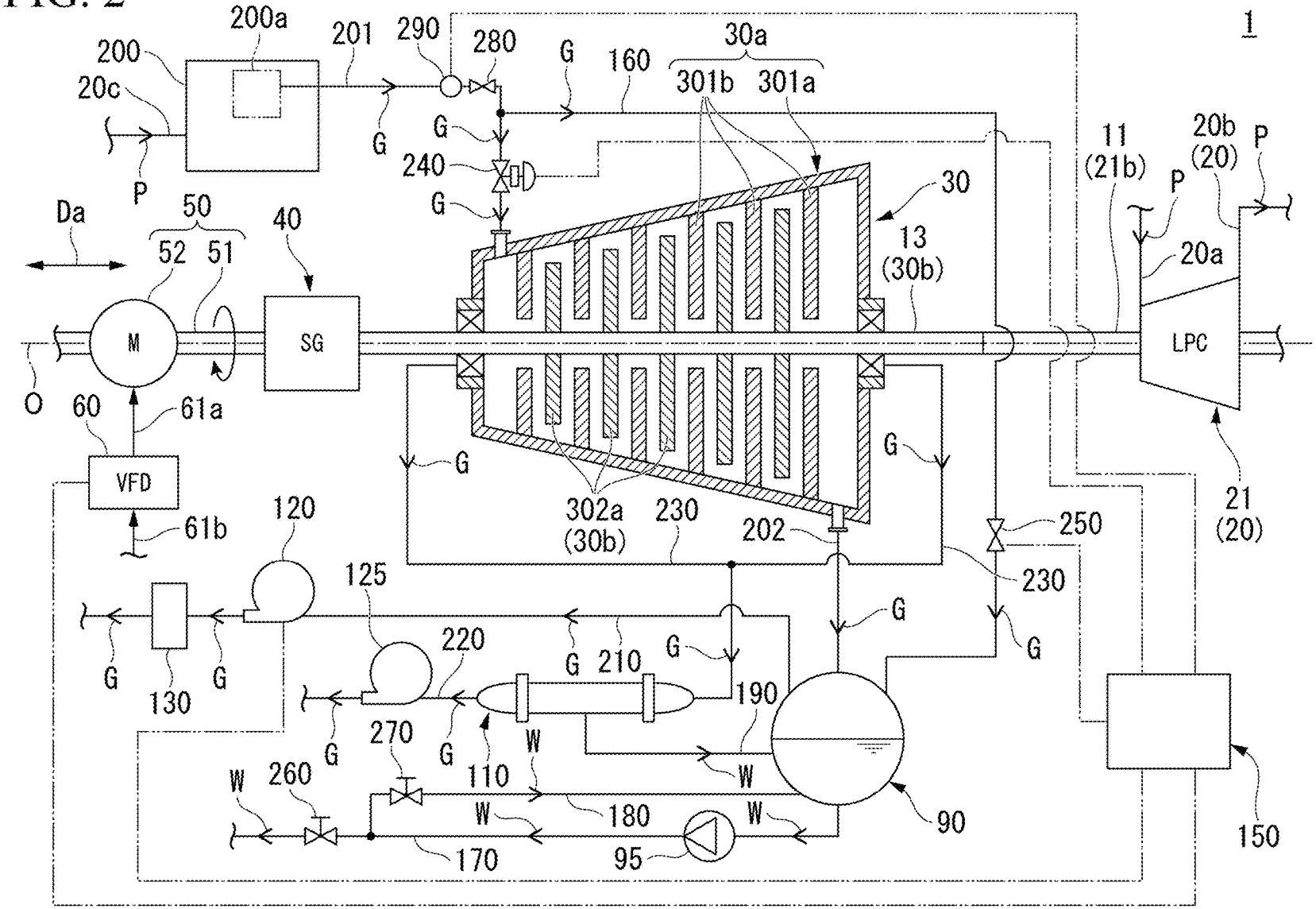
FIG. 2 is a diagram showing a main part (system) of the compressor train for a chemical plant according to the embodiment of the present disclosure.

As shown in FIG. 2, the steam turbine 30 includes a turbine stator 30*a* (stator) and a turbine rotor 30*b* (rotor).

The turbine stator 30*a* includes a turbine casing 301*a* that causes steam G to flow inside, and a plurality of stages of stator blades 301*b* that extend from an inner surface of the turbine casing 301*a* toward an inner side and rectify a flow of the steam G as the operating fluid.

The turbine casing 301*a* constitutes an outer shell of the steam turbine 30. The turbine casing 301*a* includes a turbine casing main body 330, a steam inlet portion 331 for introducing the steam G, which is formed in the turbine casing main body, and a steam outlet portion (not shown) for exhausting the steam G, which is formed in the turbine casing main body. The stator blade 301*b* extends from the inner surface of the turbine casing main body toward an inner side. The stator blade 301*b* rectifies a flow of the steam G as the operating fluid inside the turbine casing main body.

Figure 3:
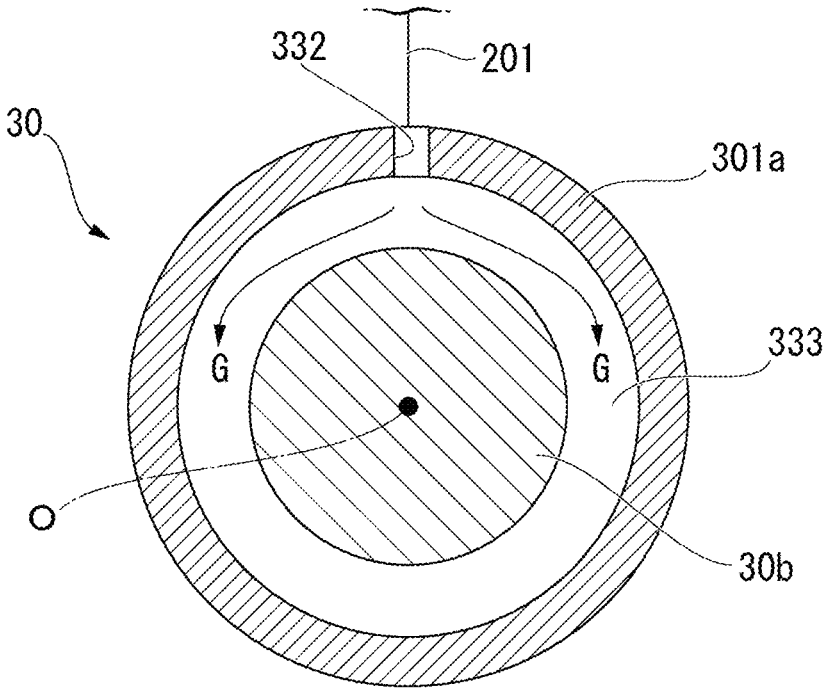
FIG. 3 is a cross-sectional view showing a configuration of a steam turbine according to the embodiment of the present disclosure.

Here, as shown in FIG. 3, on the most one side (that is, the upstream side) of the turbine casing 301*a* in the direction of the axis O, an inflow flow path 332 through which the steam G flows and a guide flow path 333 are formed on the upstream side of the first stage stator blade 301*b*. The inflow flow path 332 has an annular shape centered on the axis O. That is, when viewed from the direction of the axis O, the turbine rotor 30*b* (described below) is disposed on the inner peripheral side of the inflow flow path 332, and the first stage stator blade 301*b* is disposed on the outer peripheral side.

The guide flow path 333 is a flow path that communicates the steam inlet portion 331 with the inflow flow path 332. The guide flow path extends in a radial direction with respect to the axis O, for example. In addition, one guide flow path 333 is disposed at only one location in the circumferential direction with respect to the axis O.

The turbine rotor 30*b* includes a turbine rotation shaft 13, and a plurality of stages of rotor blades 302*a* that are fixed to the turbine rotation shaft 13 and rotate about the axis O together with the turbine rotation shaft 13 when the rectified steam G collides with the stator blade 301*b* of the turbine stator 30*a*.

The rotor blade 302*a* is accommodated in the turbine casing main body. The rotor blade 302*a* is integrally formed with the turbine rotation shaft 13 and extends from an outer surface of the turbine rotation shaft 13 toward an outer side. The rotor blade 302*a* receives pressure from the steam G inside the turbine casing main body as a rotational force that rotates the turbine rotation shaft 13.

The turbine rotor 30*b* forms a flow path of the steam G together with the inner surface of the turbine casing main body in the turbine casing 301*a* and the surface of the stator blade 301*b*. The stator blade 301*b* and the rotor blade 302*a* are alternately disposed in the axial direction Da.

A flow of the steam G introduced into the steam turbine 30 will be described below. The steam G introduced into the turbine casing main body via the steam inlet portion connected to the steam introduction line 201 is rectified by the stator blade 301*b* and collides with the rear stage rotor blade 302*a* to rotate the rotor blade 302*a* about the axis O. The steam G collided with the rotor blade 302*a* is rectified again by the rear stage stator blade 301*b* and then collides with the rear stage rotor blade 302*a*.

The steam G introduced into the inside of the turbine stator 30*a* continues to rotate the turbine rotor 30*b* by repeating rectification by the stator blade 301*b* and collision with the rotor blade 302*a*. That is, the steam G introduced into the steam turbine 30 continues to rotate the turbine rotation shaft 13 of the turbine rotor 30*b*.

The steam G introduced into the inside of the turbine stator 30*a* continues to rotate the turbine rotor 30*b* by repeating rectification by the stator blade and collision with the rotor blade. That is, the steam G introduced into the steam turbine 30 continues to rotate the turbine rotation shaft 13 of the turbine rotor 30*b*.

Here, an end portion of the turbine rotation shaft 13 of the turbine rotor 30*b* on one side in the axial direction Da and an end portion of the first rotation shaft 11 of the first rotor 21*b* on the other side in the axial direction Da are integrally connected to each other. Specifically, the turbine rotation shaft 13 and the first rotation shaft 11 are elastically connected to each other by a coupling or the like (not shown) having flexibility.

The turbine rotation shaft 13 and the first rotation shaft 11 are connected to each other such that the centers of both are aligned. That is, the center line of the turbine rotation shaft 13 and the center line of the first rotation shaft 11 are on the same straight line. That is, the turbine rotation shaft 13 and the first rotation shaft 11 share the axis O as the center line.

Therefore, when the steam turbine 30 rotates the turbine rotation shaft 13, the first rotation shaft 11 and the second rotation shaft 12 in the compression unit 20 rotate with this rotation. Therefore, the compression unit 20 is driven by the rotation of the steam turbine 30.

In the present embodiment, the turbine rotation shaft 13 in the steam turbine 30, the first rotation shaft 11 in the low pressure stage compressor 21, and the second rotation shaft 12 in the high pressure stage compressor 22 are integrated with each other to form the rotation shaft 10 which is one driving shaft extending in the axial direction Da. That is, the rotation shaft 10 is rotatable about the axis O with the axis O as a center.

The steam G collides with the last stage rotor blade 302*a* and is then exhausted to the outside of the steam turbine 30 via the steam outlet portion in the turbine casing 301*a*. The steam exhaust line 202, which is a pipe for exhausting the steam G, is connected to the steam outlet portion, and the steam G is introduced into the condenser 90 disposed outside the steam turbine 30 through the steam exhaust line 202.

(Frequency Conversion Unit)

The frequency conversion unit 60 (variable frequency drive: VFD) is a device that is connected to the power system Gr outside the compressor train 1 for a chemical plant and that performs rotation control of the motor 50. The frequency conversion unit 60 in the present embodiment is an inverter that is connected to the power system Gr and the motor 50 and converts the direct current power supplied from the power system Gr into three-phase alternating current power to input the alternating current power to the motor 50.

The first power purchase cable 61*a* and the second power purchase cable 61*b* are connected to the frequency conversion unit 60. The first power purchase cable 61*a* electrically connects the frequency conversion unit 60 and the motor stator of the motor 50. The second power purchase cable 61*b* is electrically connected to the frequency conversion unit 60 and the power system Gr.

As a result, the direct current power flowing through the power system Gr is input to the frequency conversion unit 60 via the second power purchase cable 61*b*. The direct current power input to the frequency conversion unit 60 is converted into alternating current power by, for example, a power module or the like provided in the frequency conversion unit 60, and then is input to the motor 50 via the first power purchase cable 61*a*. Therefore, the motor 50 is driven by purchasing electric power from the power system Gr via the frequency conversion unit 60.

(Condenser)

The condenser 90 is connected to the steam turbine 30 by the steam exhaust line 202, for example. The condenser 90 cools and condenses the steam G exhausted from the steam outlet portion of the turbine casing 301*a* through the steam exhaust line 202. The condenser 90 is connected to the drainage line 170. The condenser 90 exhausts the water W accumulated inside to the outside of the condenser 90 through the drainage line 170.

In addition, the condenser 90 is connected to the first suction line 210. The condenser 90 exhausts the air that flows in from the gap such as a device joint portion to the outside of the condenser 90 from the first suction line 210. In addition, the condenser 90 is connected to the circulation line 180. In addition, the circulation line 180 is connected to the drainage line 170.

In addition, the connection line 160 is connected to the condenser 90. The connection line 160 connects the steam introduction line 201 and the condenser 90 to each other. Therefore, the connection line 160 can guide the steam G flowing from the steam introduction line 201 toward the steam turbine 30 to the condenser 90. In addition, the dump valve 250 is disposed in the connection line 160. The dump valve 250 adjusts its own opening degree by receiving a signal indicating the opening degree transmitted from the control device 150. The dump valve 250 reduces the pressure of the steam G flowing through the connection line 160 according to the opening degree.

In addition, the governing valve 240 is disposed at a position closer to the steam turbine 30 than the connection point to the connection line 160 in the steam introduction line 201. The governing valve 240 adjusts its own opening degree by receiving a signal indicating the opening degree transmitted from the control device 150. Although not shown in detail, the governing valve 240 includes only one valve main body and only one valve body whose posture can be adjusted in the valve main body. That is, unlike the related art, the governing valve 240 does not include a plurality of valve bodies. Therefore, only one guide flow path 333 described above is also disposed in correspondence with only one valve body. In addition, it is desirable that the governing valve 240 is disposed on the steam introduction line 201 but may be integrally attached to the turbine casing 301*a* of the steam turbine 30.

In addition, the flow rate sensor 290 is disposed at a position closer to the ammonia converter 200 than the connection point to the connection line 160 in the steam introduction line 201. The flow rate sensor 290 detects the amount of the steam G flowing through the steam introduction line 201. The flow rate sensor 290 transmits a signal indicating the detected amount of the steam G to the control device 150.

Furthermore, the main trip and throttle valve (TTV) 280 is disposed between the governing valve 240 and the flow rate sensor 290 in the steam introduction line 201. The main trip and throttle valve 280 is disposed to immediately block the flow of the steam in the steam introduction line 201 in a case where the system requires an emergency stop. That is, the main trip and throttle valve 280 causes steam to flow in or block the steam.

(Condensate Pump)

The condensate pump 95 is disposed in the drainage line 170. The condensate pump 95 circulates the water W condensed in the condenser 90 to an external device (not shown) such as a boiler through the drainage line 170. The first opening and closing valve 260 is disposed at a portion on the downstream side of the condensate pump 95 in the drainage line 170. In addition, the circulation line 180 that connects the drainage line 170 and the condenser 90 is connected to the drainage line 170.

The first opening and closing valve 260 is disposed on the downstream side than a connection point to the circulation line 180 in the drainage line 170. In addition, the second opening and closing valve 270 is disposed in the circulation line 180. By adjusting the opening degree of the first opening and closing valve 260 and the second opening and closing valve 270, the inflow amount of the water W from the condenser 90 to the boiler described above and the return amount of the water W to the condenser 90 are adjusted.

(Grand Condenser)

The grand condenser 110 is connected to the steam turbine 30, for example, via the leak steam line 230. The grand condenser 110 deaerates the leaked steam that flows out to the outside of the turbine stator 30*a* from a gap between the turbine stator 30*a* and the turbine rotor 30*b* of the steam turbine 30. The grand condenser 110 in the present embodiment condenses the leaked steam (grand steam) from the gap between the turbine rotation shaft 13 of the turbine rotor 30*b* and an opening portion formed at both ends of the casing main body in the axial direction Da of the turbine stator 30*a*.

Therefore, the inside of the grand condenser 110 communicates with the gap between the turbine rotation shaft 13 and the opening portion of the casing main body through the leak steam line 230. The grand condenser 110 in the present embodiment is, for example, a shell-and-tube type heat exchanger.

The grand condenser 110 is connected to the condenser 90 via the condensate recovery line 190. The grand condenser 110 supplies the water W for activation to the condenser 90 when the steam turbine 30 is activated. The grand condenser 110 supplies the leaked steam and the water W obtained by deaerating the condensed water W during the operation of the steam turbine 30 to the condenser 90 through the condensate recovery line 190. As a result, the grand condenser 110 controls the liquid level of the condenser 90 during the operation of the steam turbine 30.

(Vacuum Pump)

The vacuum pump 120 is connected to the condenser 90 via the first suction line 210.

The vacuum pump 120 is driven to suck the air inside the condenser 90. As a result, the vacuum pump 120 reduces the pressure inside the condenser 90 to a negative pressure. In a case where the steam turbine 30 is not driven, the vacuum pump 120 is driven, so that the air inside the condenser 90 is sucked, and the air inside the steam turbine 30 is sucked into the condenser 90 through the steam exhaust line 202. As a result, the pressure inside the steam turbine 30 is reduced.

The drain separator 130 is disposed in the first suction line 210 on the downstream side than the vacuum pump 120. The drain separator 130 further separates the air sucked by the vacuum pump 120 into air and liquid. Each of the liquid phase components and the gas phase components separated by the drain separator 130 into air and liquid is exhausted, for example, to the outside of the compressor train 1 for a chemical plant.

(Vapor Fan)

The vapor fan 125 is disposed in the second suction line 220 connected to the grand condenser. The vapor fan 125 is electrically driven to remove the air in the grand condenser 110 and to maintain the inside of the grand condenser 110 at a slight negative pressure.

(Operation and Effect)

Here, in the chemical plant in the related art, it has been common to mainly use the power of the steam turbine 30 in order to drive the compression unit 20. However, it is promising to adopt a configuration in which the compression unit 20 is mainly driven by the electric motor (motor 50) and the power of the motor 50 is assisted by the steam turbine 30, as in the compressor train 1 for a chemical plant according to the present embodiment. In that case, precise control such as steam flow rate is no longer required for the steam turbine 30. Therefore, there is a problem that the configuration of the steam turbine 30 in the plant in the related art is over-specified, which leads to an increase in operating costs and maintenance costs. In order to solve the above-described problems, the present embodiment adopts each of the above-described configurations.

With the above configuration, the compression unit 20 is mainly driven by the motor 50, and the steam turbine 30 is used to assist the driving force of the motor 50. Therefore, it is not necessary to adjust the rotation speed of the compression unit 20 by the steam turbine 30. Therefore, it is not necessary to perform precise steam flow rate control in the steam turbine 30. Therefore, the configuration of the compressor train 1 for a chemical plant can be simplified, so that the manufacturing costs and the maintenance costs of the apparatus can be significantly reduced. As a result, it is possible to reduce the price of the chemical product, which is the final product, and it is possible to use the chemical product in various industries in a large amount and at a low cost.

With the above configuration, the governing valve 240 is disposed between the main trip and throttle valve 280 and the steam turbine 30. Therefore, by adjusting the opening degree of the governing valve 240, various types of operation tests and the like related to the steam turbine 30 can be smoothly performed.

With the above configuration, since it is not necessary to precisely adjust the steam flow rate in the steam turbine 30, it is not necessary to use the valve device having a plurality of valve bodies as in the related art in providing the governing valve 240. That is, a valve device having only one valve body can be adopted as the governing valve. As a result, the configuration can be further simplified, and the maintenance costs and the manufacturing costs can be further reduced. As a result, it is possible to reduce the price of the chemical product, which is the final product of the compressor train 1 for a chemical plant, and it is possible to promote the widespread use of the chemical product in various industries.

With the above configuration, since it is not necessary to precisely adjust the steam flow rate in the steam turbine 30, it is not necessary to form a plurality of flow paths communicating with the valve device having the plurality of valve bodies as in the related art in providing the inflow flow path 332 in the casing (turbine casing 301*a*). As a result, the configuration can be further simplified, and the maintenance costs and the manufacturing costs can be further reduced. As a result, it is possible to reduce the price of the chemical product, which is the final product of the compressor train 1 for a chemical plant, and it is possible to promote the widespread use of the chemical product in various industries.

Other Embodiments

While preferred embodiments of the invention have been described and illustrated above, it should be understood that these are exemplary of the invention and are not to be considered as limiting. Additions, omissions, substitutions, and other modifications can be made without departing from the scope of the invention. Accordingly, the invention is not to be considered as being limited by the foregoing description and is only limited by the scope of the appended claims.

For example, in the above-described embodiment, the example is described in which the governing valve 240 is disposed on the steam introduction line 201. However, a configuration in which the governing valve 240 is not provided can also be adopted. This is because the adjustment of rotation speed of the compression unit 20 can be controlled by the motor 50, and thus the steam turbine 30, which is an auxiliary power source, does not need to precisely control the steam flow rate.

With the above configuration, no valve device is provided between the main trip and throttle valve 280 and the steam turbine 30. As a result, the steam turbine 30 can be operated by a simple method with a simpler configuration. Therefore, since the complexity of the device is avoided, the frequency of maintenance is suppressed, and it is possible to continue to operate the compressor train 1 for a chemical plant more inexpensively and stably. In particular, the risk of failure occurrence is also reduced by reducing the number of parts. Therefore, as described above, it is possible to significantly reduce the frequency of maintenance and the costs required for the maintenance.

APPENDIX

The compressor train for a chemical plant described in each embodiment is grasped, for example, as follows.

(1) The compressor train 1 for a chemical plant according to a first aspect includes a compression unit 20 that compresses a process gas of the chemical plant by being driven, a motor 50 that drives the compression unit 20, a steam turbine 30 that is rotated by steam G generated in association with treatment of the process gas P of the chemical plant and configured to assist in rotation of the motor 50, a steam introduction line 201 through which the steam G flows toward the steam turbine 30, and a main trip and throttle valve 280 that is disposed on the steam introduction line 201 and blocks or causes the steam G to flow into the steam turbine 30.

With the above configuration, the compression unit 20 is mainly driven by the motor 50, and the steam turbine 30 is used to assist the driving force of the motor 50. Therefore, it is not necessary to adjust the rotation speed of the compression unit 20 by the steam turbine 30. Therefore, it is not necessary to perform precise steam flow rate control in the steam turbine 30. The manufacturing costs and maintenance costs of the apparatus can be significantly reduced.

(2) A compressor train 1 for a chemical plant according to a second aspect is the compressor train 1 for a chemical plant according to (1), in which another valve device is not disposed between the steam turbine 30 and the main trip and throttle valve 280 on the steam introduction line 201.

With the above configuration, no valve device is provided between the main trip and throttle valve 280 and the steam turbine 30. As a result, the steam turbine 30 can be operated by a simple method with a simpler configuration.

(3) A compressor train 1 for a chemical plant according to a third aspect is the compressor train 1 for a chemical plant according to (1), the compressor train further includes a governing valve 240 that is disposed between the steam turbine 30 and the main trip and throttle valve 280 and switches a flow state of the steam G.

With the above configuration, the governing valve 240 is provided between the main trip and throttle valve 280 and the steam turbine 30. Therefore, by adjusting the opening degree of the governing valve 240, various types of operation tests and the like related to the steam turbine 30 can be smoothly performed.

(4) A compressor train 1 for a chemical plant according to a fourth aspect is the compressor train 1 for a chemical plant according to (3), in which the governing valve 240 has only one valve body configured to switch a posture between an open state and a closed state.

With the above configuration, since it is not necessary to precisely adjust the steam flow rate in the steam turbine 30, it is not necessary to use the valve device having a plurality of valve bodies as in the related art in providing the governing valve 240. As a result, the configuration can be further simplified, and the maintenance costs and the manufacturing costs can be further reduced.

(5) A compressor train 1 for a chemical plant according to a fifth aspect is the compressor train 1 for a chemical plant according to any one of (1) to (4), in which the steam turbine 30 includes a rotor (turbine rotor 30*b*) and a casing (turbine casing 301*a*) that forms a flow path through which the steam G flows by covering the rotor from an outer peripheral side, and the casing includes an inflow flow path 332 that is formed on an upstream side with respect to a first stage stator blade 301*b* in the casing, in which the steam G flows, and has an annular shape centered on a central axis (axis O) of the rotor, and only one guide flow path 333 that connects the inflow flow path 332 and the main trip and throttle valve 280.

With the above configuration, since it is not necessary to precisely adjust the steam flow rate in the steam turbine 30, it is not necessary to form a plurality of flow paths communicating with the valve device having the plurality of valve bodies as in the related art in providing the inflow flow path 332 in the casing (turbine casing 301*a*). As a result, the configuration can be further simplified, and the maintenance costs and the manufacturing costs can be further reduced.

EXPLANATION OF REFERENCES

1: compressor train for chemical plant
10: rotation shaft
11: first rotation shaft
12: second rotation shaft
13: turbine rotation shaft
20: compression unit
20*a*: gas introduction line
20*b*: intermediate line
20*c*: gas exhaust line
21: low pressure stage compressor
22: high pressure stage compressor
30: steam turbine
30*a*: turbine stator
30*b*: turbine rotor
40: speed increasing gear
50: motor
51: output shaft

52: motor main body
60: frequency conversion unit
61*a*: first power purchase cable
61*b*: second power purchase cable
62*a*: first power selling cable
62*b*: second power selling cable
90: condenser
90: condensate pump
100: ammonia plant
110: grand condenser
120: vacuum pump
125: vapor fan
130: drain separator
150: control device
160: connection line
170: drainage line
180: circulation line
190: condensate recovery line
200: ammonia converter
200*a*: boiler
201: steam introduction line
202: steam exhaust line
210: first suction line
220: second suction line
230: leak steam line
240: governing valve
250: dump valve
260: first opening and closing valve
270: second opening and closing valve
280: main trip and throttle valve
290: flow rate sensor
301*a*: turbine casing
301*b*: stator blade
302*a*: rotor blade
332: inflow flow path
333: guide flow path
Da: axial direction
G: steam
Gr: power system
O: axis
P: process gas
W: water

What is claimed is:

1. A compressor train for a chemical plant, comprising:

a compression unit comprising a rotation shaft rotatable about an axis as a center and configured to compress a process gas of the chemical plant;

a motor comprising an output shaft rotatable about the axis as a center and configured to drive the compression unit and to adjust a rotation speed of the compression unit;

a steam turbine comprising a turbine rotation shaft rotatable about the axis as a center, rotated by steam generated in association with treatment of the process gas of the chemical plant at a rotation speed equal to or lower than a rotation speed of the motor, and configured to assist rotation of the motor;

a steam introduction line through which the steam flows toward the steam turbine; and a main trip and throttle valve disposed on the steam introduction line and configured to block or cause the steam to flow into the steam turbine, wherein the steam turbine is disposed between the motor and the compression unit in an axial direction in which the axis extends, and the rotation shaft, the turbine rotation shaft, and the output shaft are disposed on a same straight line such that the axis is shared as a center line of the rotation shaft, a center line of the turbine rotation shaft, and a center line of the output shaft.

2. The compressor train for a chemical plant according to claim 1, further comprising:

a governing valve disposed between the steam turbine and the main trip and throttle valve and configured to switch a flow state of the steam.

3. The compressor train for a chemical plant according to claim 2, wherein the governing valve has only one valve body configured to switch a posture between an open state and a closed state.

4. The compressor train for a chemical plant according to claim 1, wherein the steam turbine comprises:

a rotor; and a casing configured to form a flow path through which the steam flows by covering the rotor from an outer peripheral side, and the casing comprises:

an inflow flow path that is disposed on an upstream side with respect to a first stage stator blade in the casing, into which the steam flows, and has an annular shape centered on a central axis of the rotor; and only one guide flow path connect ing the inflow flow path and the main trip and throttle valve.

* * * * *